US008378200B1

(12) United States Patent
Beigel

(10) Patent No.: US 8,378,200 B1
(45) Date of Patent: Feb. 19, 2013

(54) SOURCE-DEPENDENT ACOUSTIC, MUSICAL AND/OR OTHER INSTRUMENT PROCESSING AND FEEDBACK SYSTEM

(76) Inventor: Michael Beigel, Encinitas, CA (US)

( * ) Notice: Subject to any disclaimer, the term of this patent is extended or adjusted under 35 U.S.C. 154(b) by 522 days.

(21) Appl. No.: 11/890,442

(22) Filed: Aug. 7, 2007

Related U.S. Application Data

(60) Provisional application No. 60/835,875, filed on Aug. 7, 2006.

(51) Int. Cl.
*G10H 5/02* (2006.01)
*G10H 1/06* (2006.01)

(52) U.S. Cl. ..... 84/659; 84/610; 84/623; 84/650

(58) Field of Classification Search ..... 84/659
See application file for complete search history.

(56) References Cited

U.S. PATENT DOCUMENTS

| | | | | |
|---|---|---|---|---|
| 4,771,671 | A * | 9/1988 | Hoff, Jr. | 84/645 |
| 5,557,424 | A * | 9/1996 | Panizza | 386/228 |
| 5,565,641 | A * | 10/1996 | Gruenbaum | 84/615 |
| 6,054,646 | A * | 4/2000 | Pal et al. | 84/608 |
| 6,057,498 | A * | 5/2000 | Barney | 84/199 |

* cited by examiner

*Primary Examiner* — Christopher Uhlir
(74) *Attorney, Agent, or Firm* — David L. Hoffman; Hoffman Patent Group

(57) ABSTRACT

The Source-Dependent Instrument is a signal processing and signal generation system that uses one or more signal event generators that can be functionally activated and controlled by the analysis of an external input signal. These output generators and signal processors can be set to re-synthesize aspects of the input or synthesize a more complex or perceptually shifted output based on the input.

19 Claims, 15 Drawing Sheets

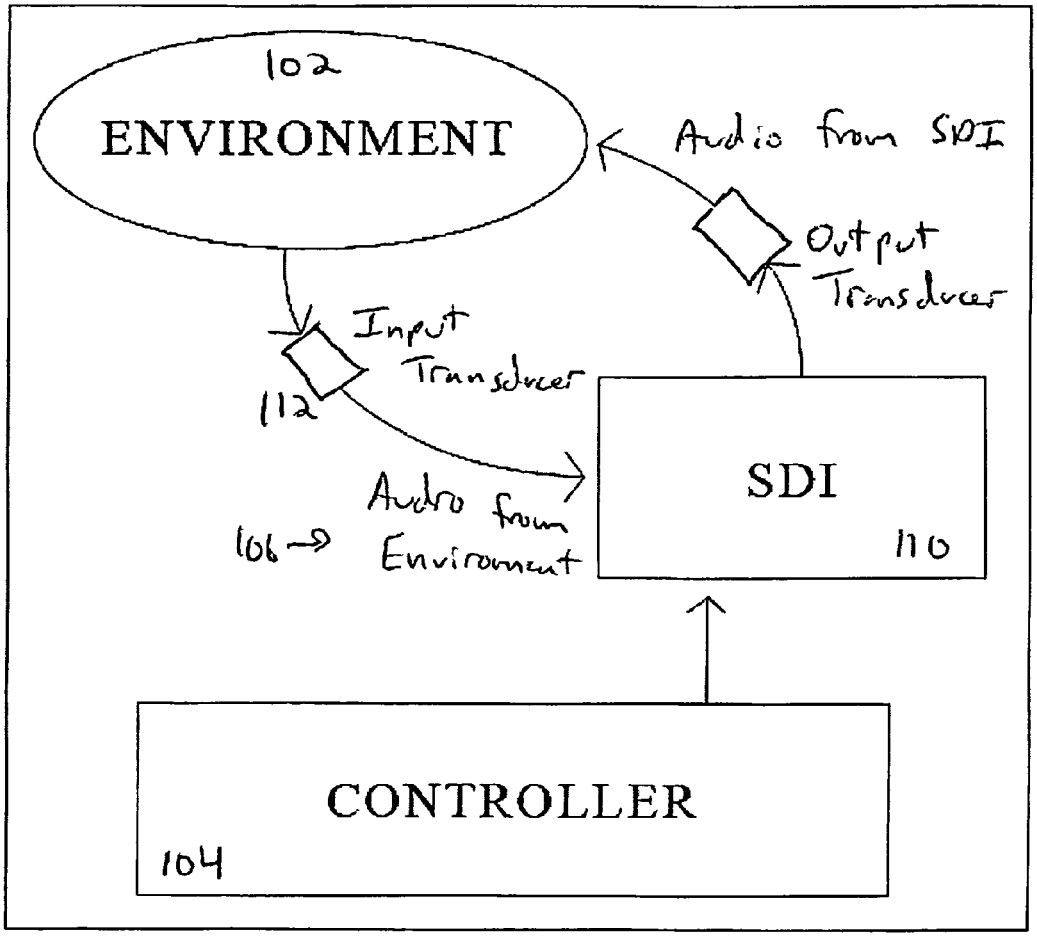
Figure 1. SDI Operation in Audio or Acoustic Environment. 100

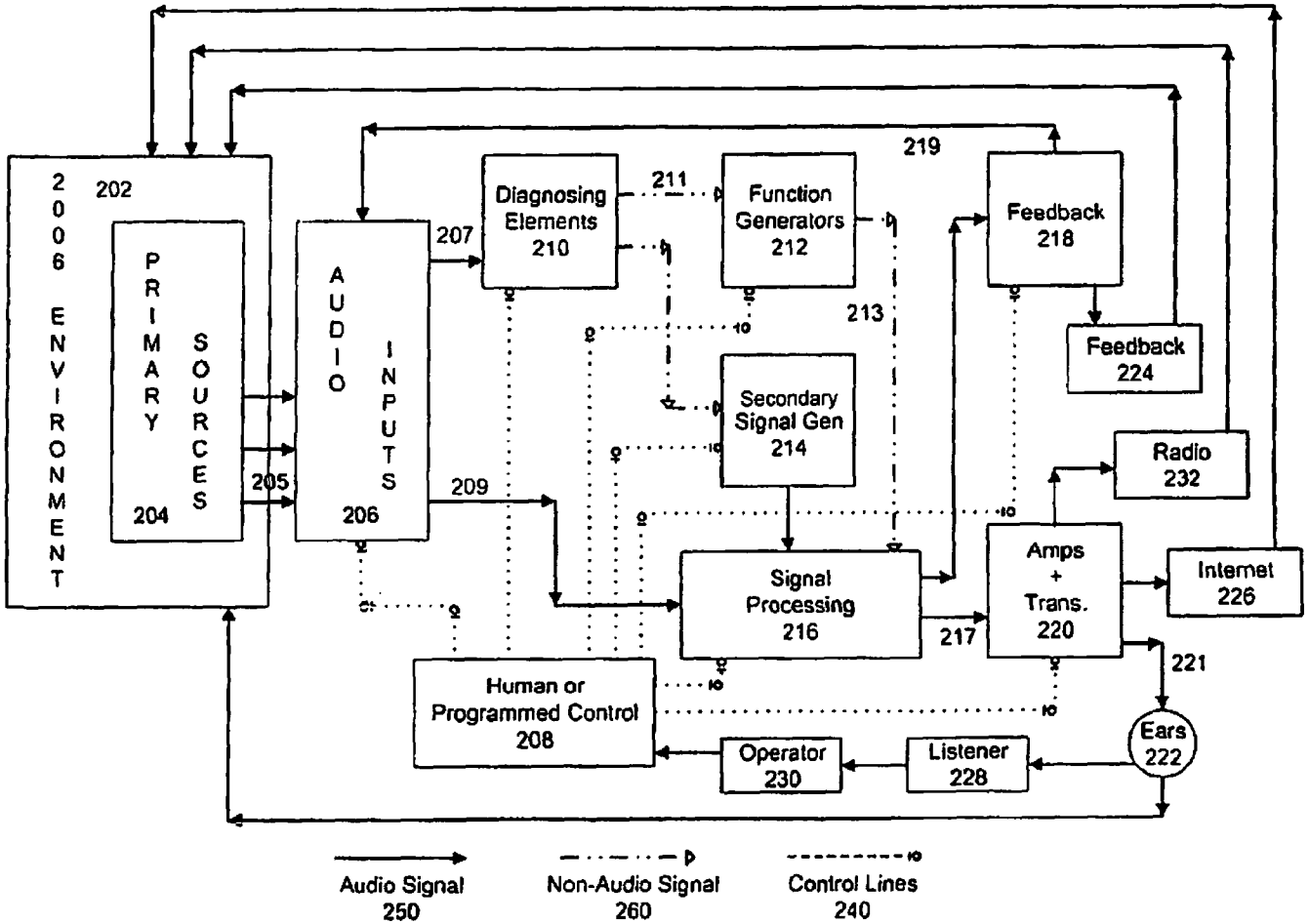
Figure 2. Generalized Source Dependent Instrument 200

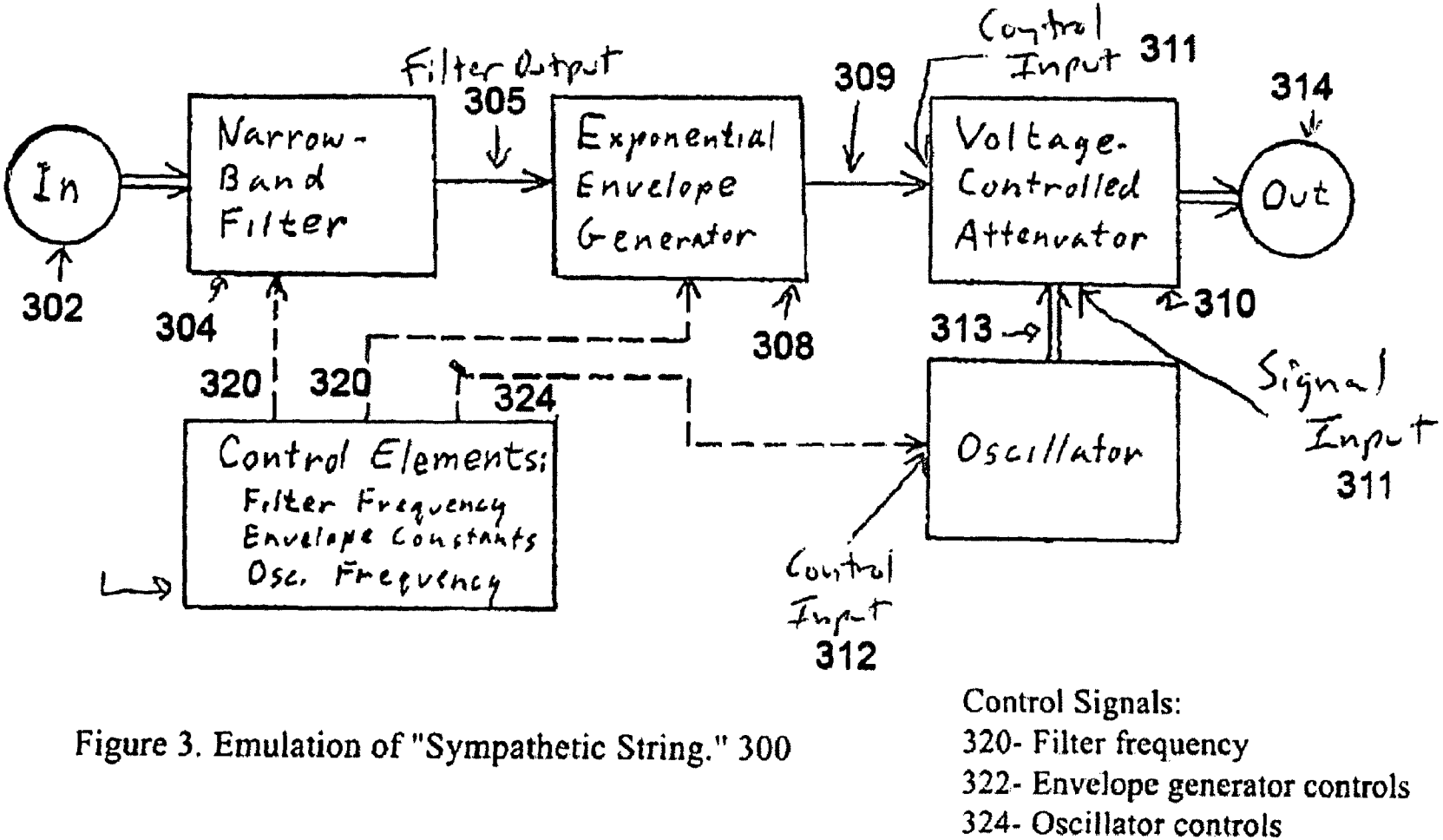
Figure 3. Emulation of "Sympathetic String." 300

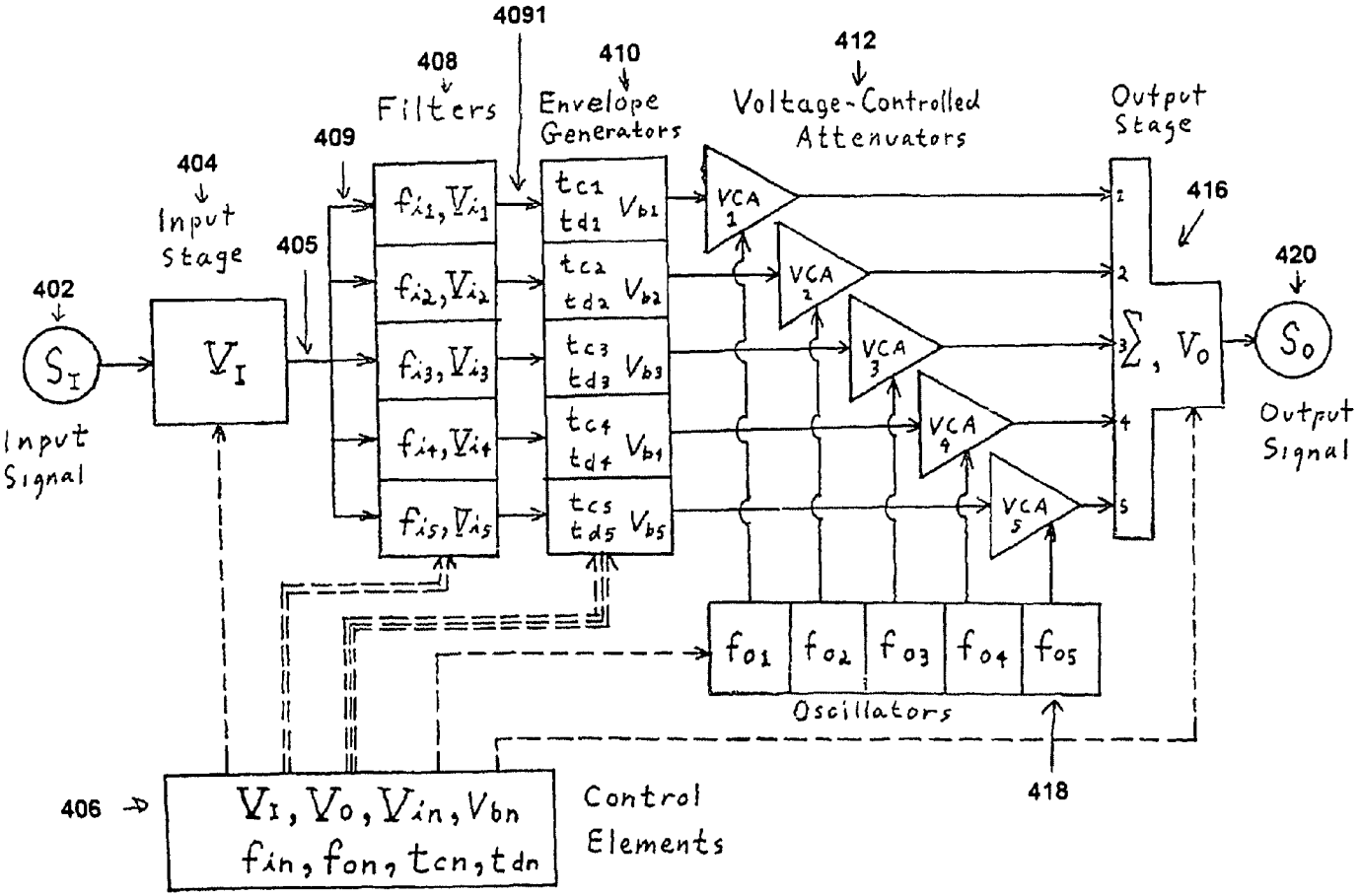
Figure 4. SDI System Diagram. 400

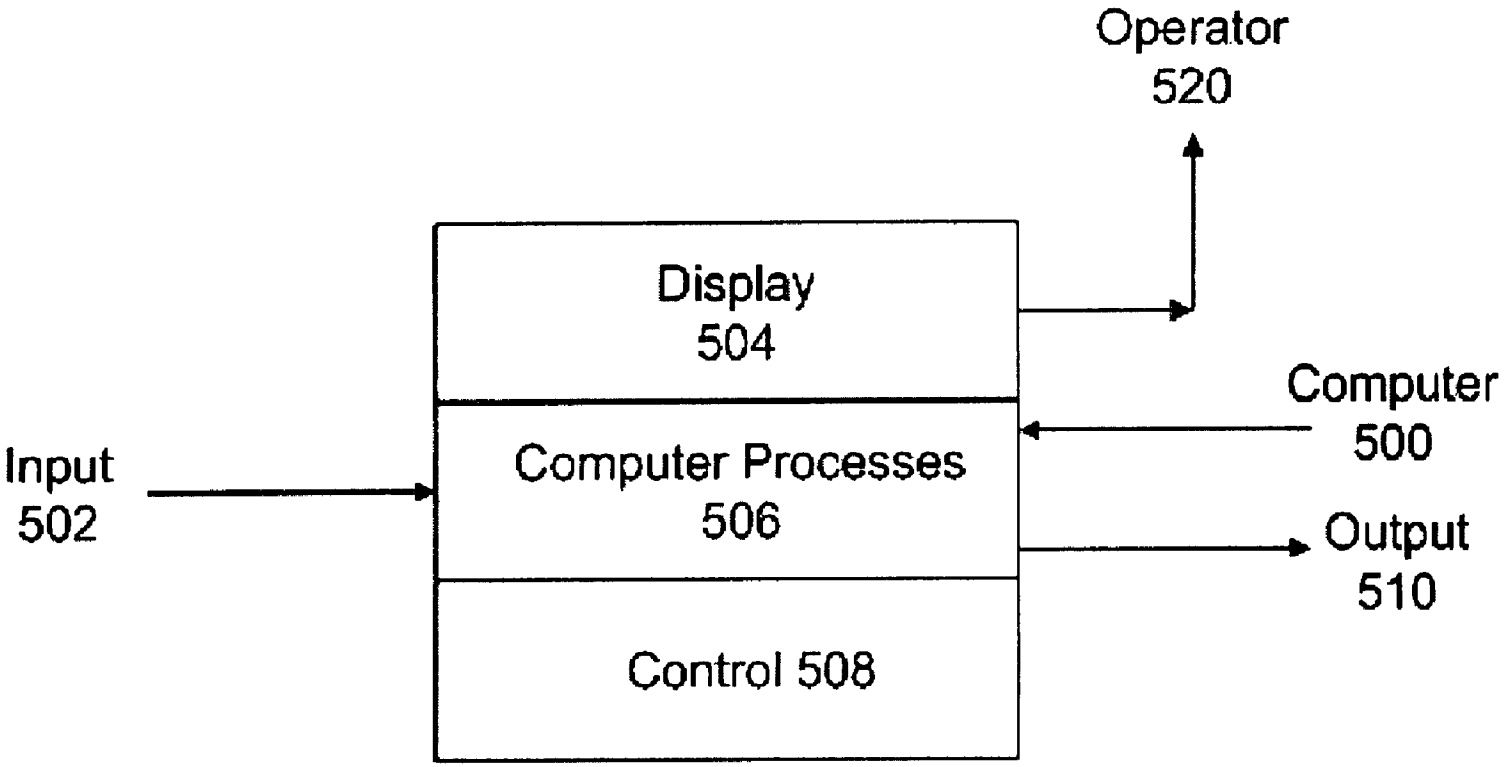
Figure 5 SDI Computer Implementation 500

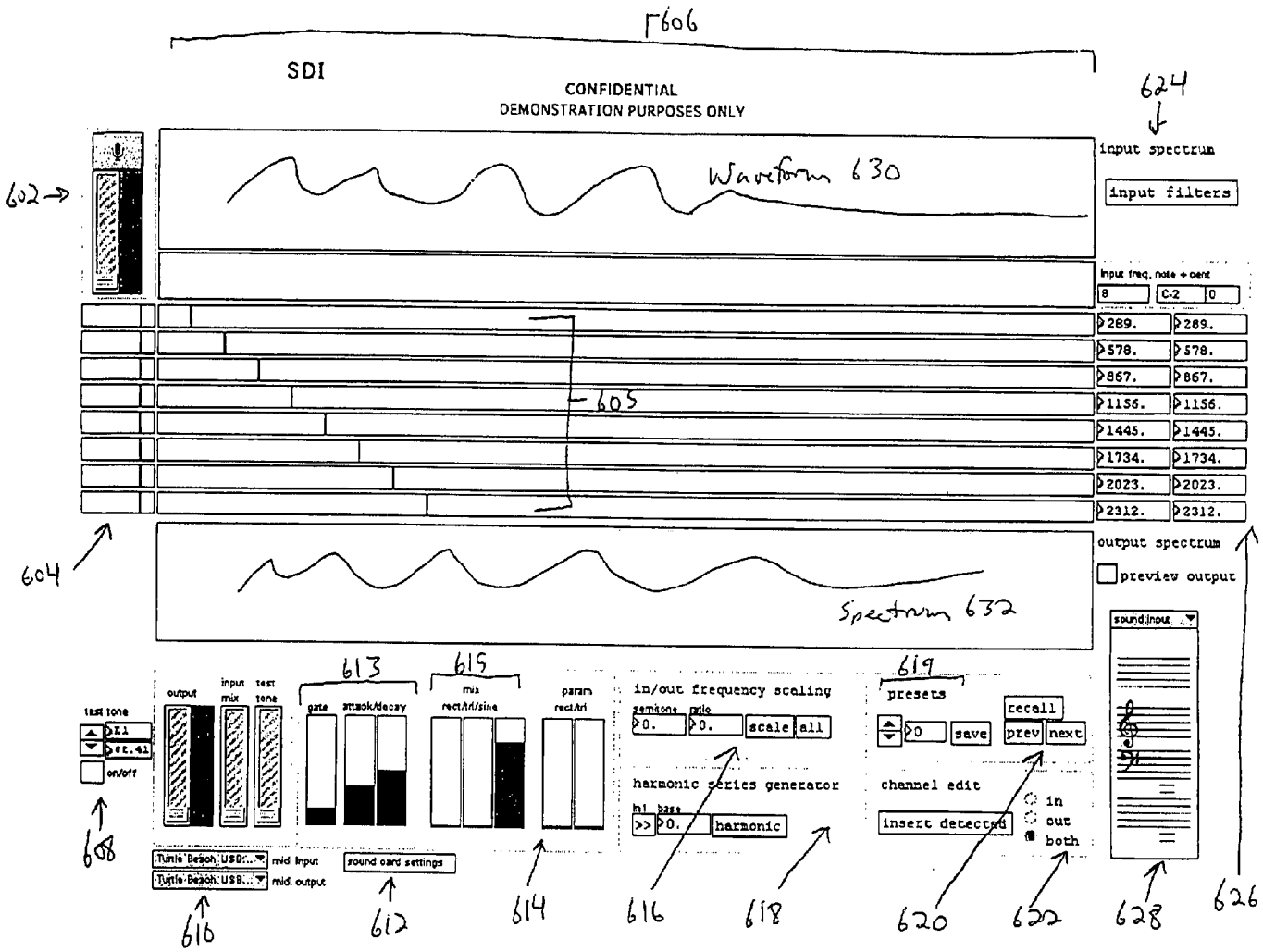
Figure 6. SDI Software Realization. 600

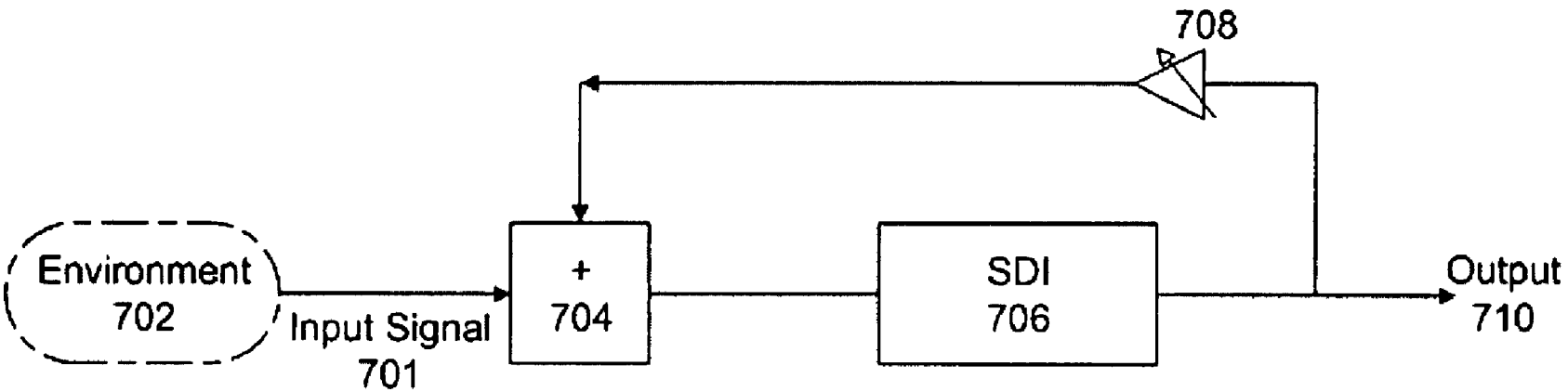
Figure 7. Internal Feedback 700

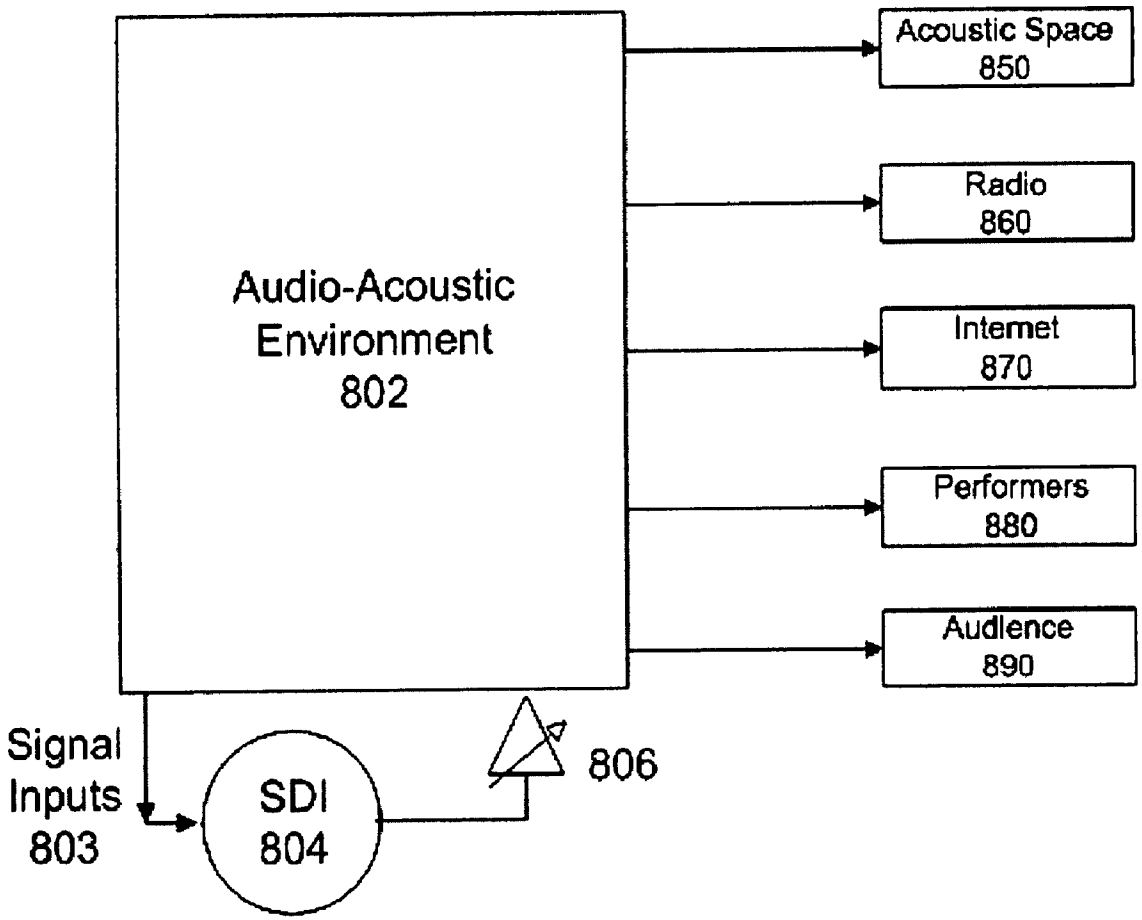
Figure 8. Feedback into Environment 800

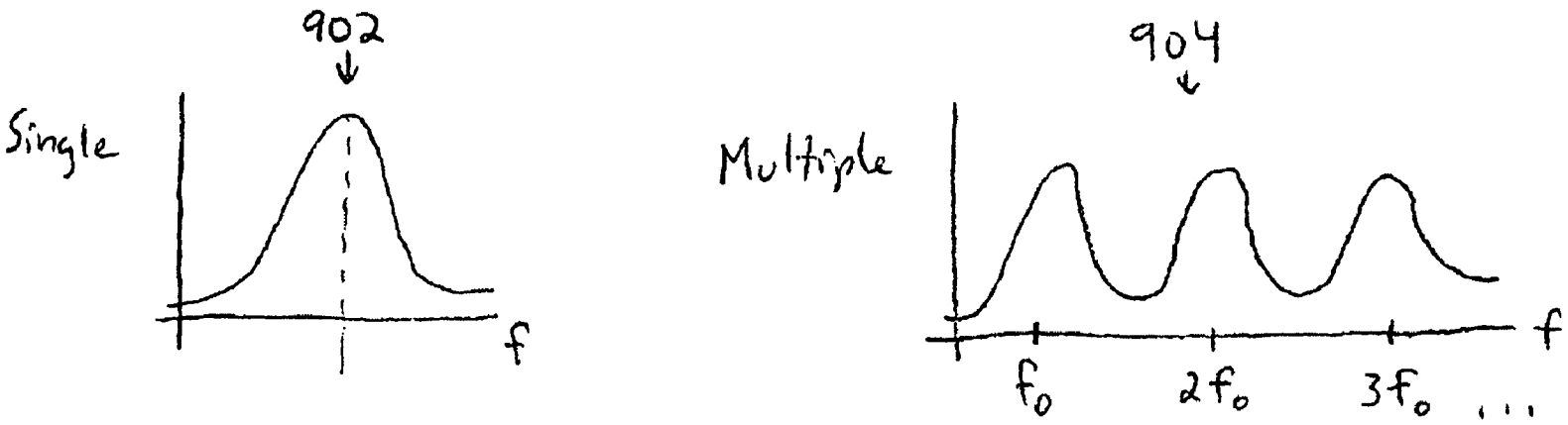
Figure 9. Frequency Response. 900

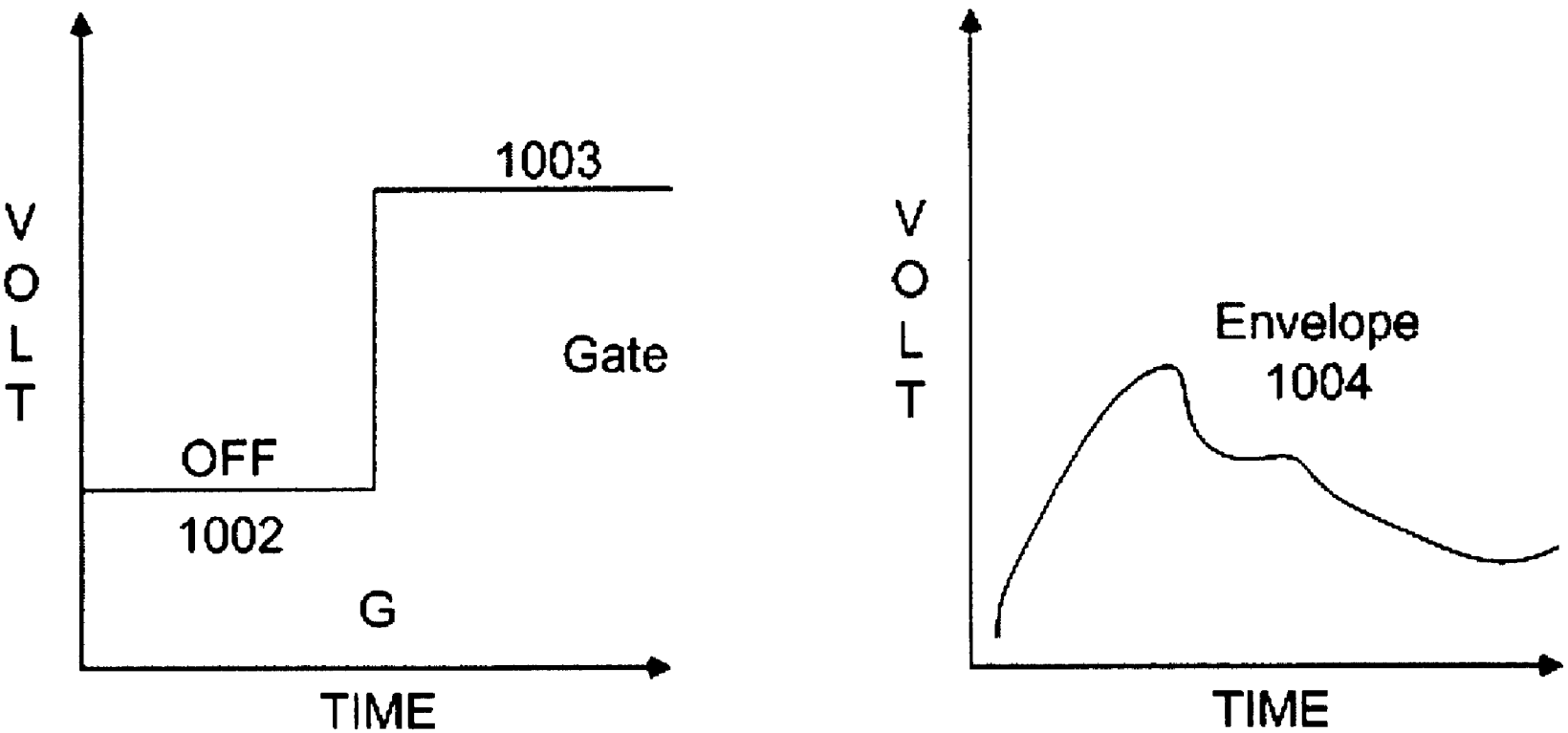
Figure 10. Envelope Control Circuit Signals 1000

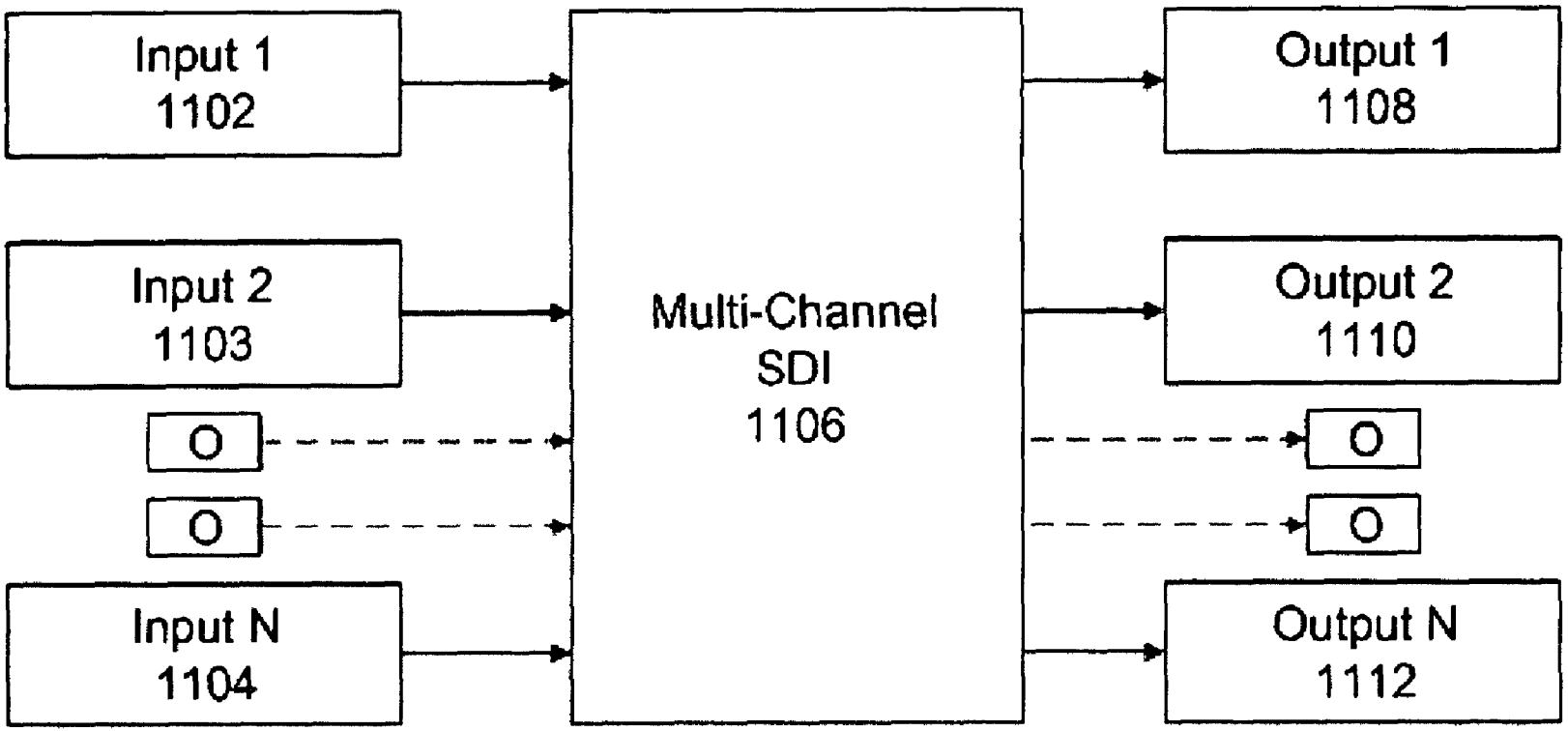
Figure 11. Multiple Audio Paths 1100

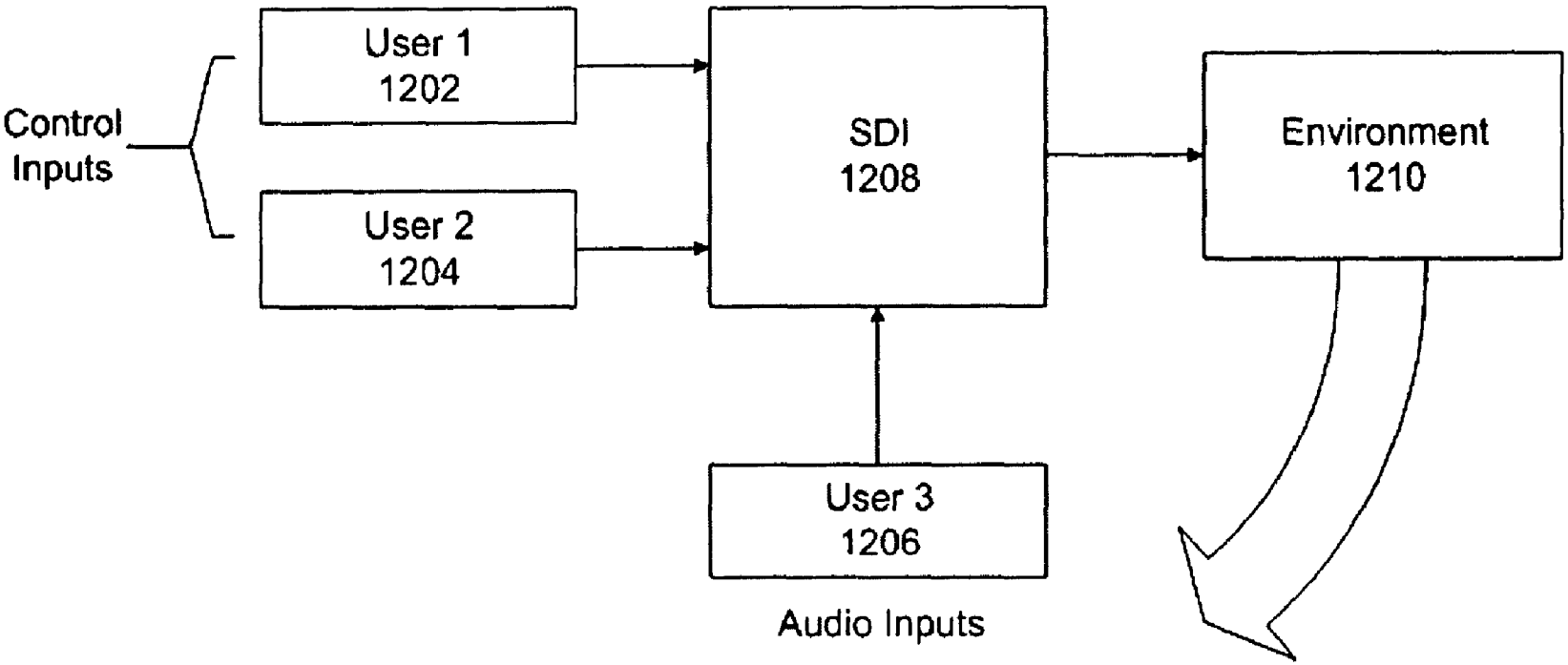
Figure 12. Multiple Users 1200

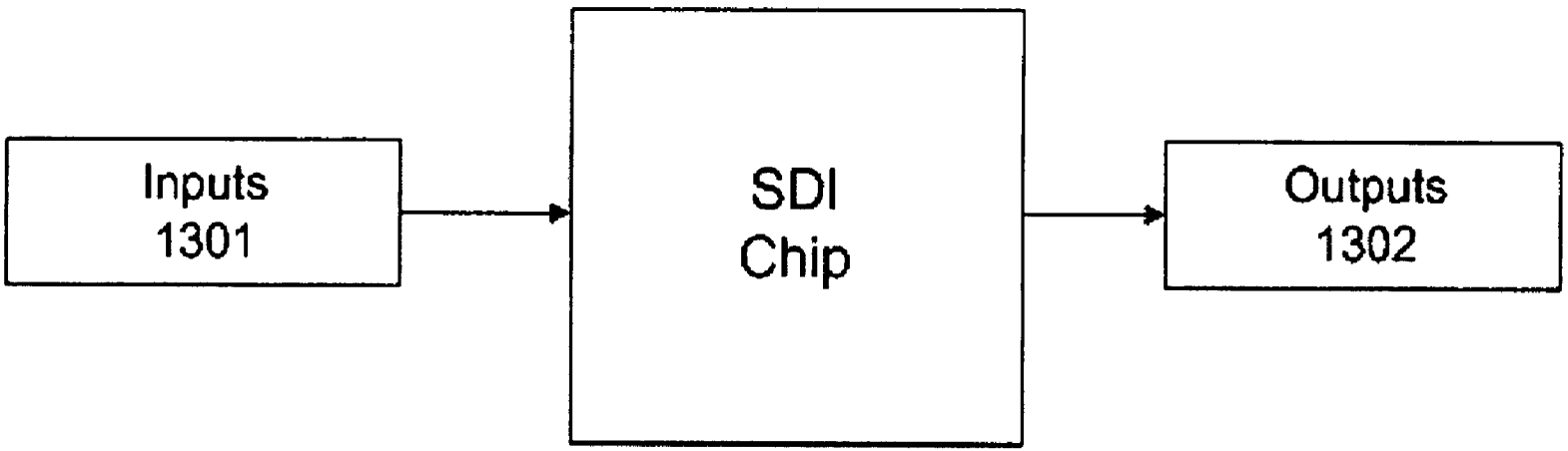
Figure 13. SDI IC Chip Implementation 1300

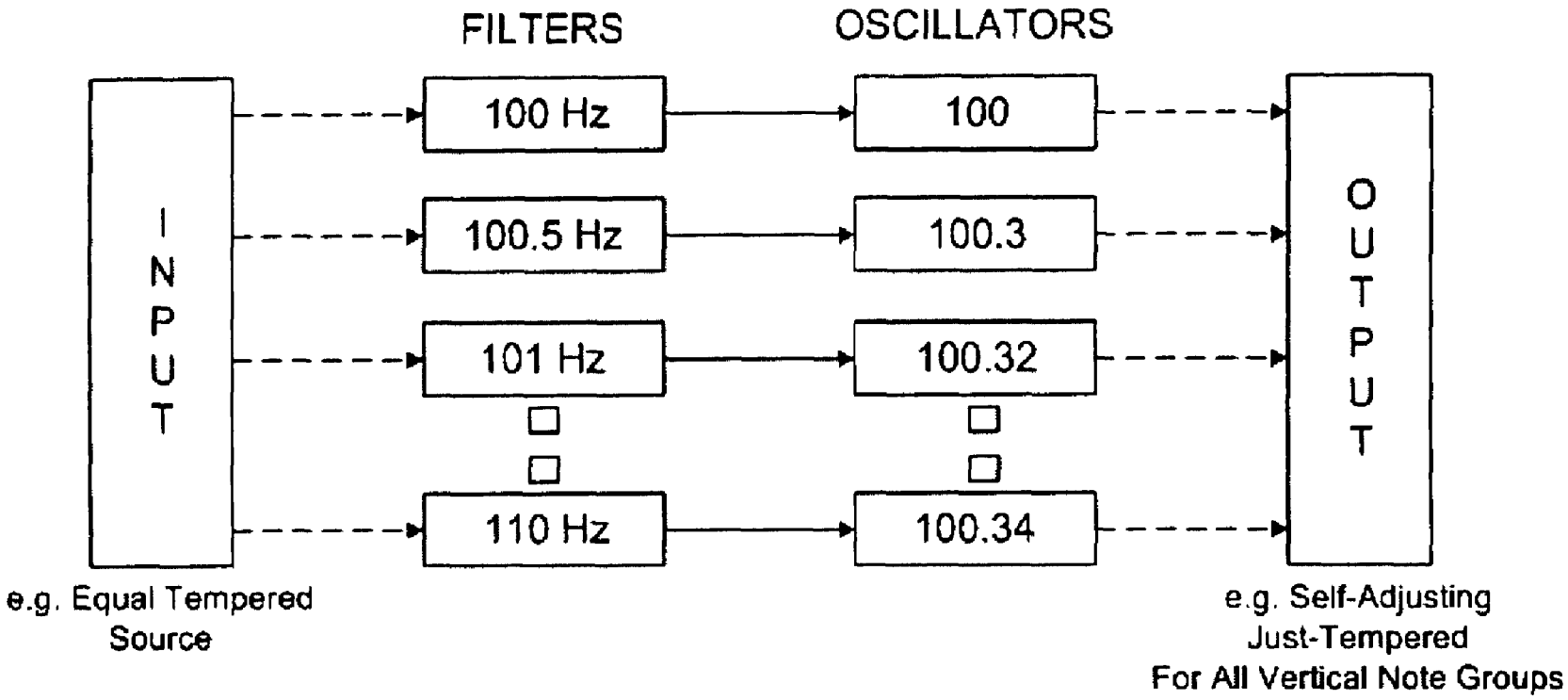
Figure 14. Tuned Input Filters and Oscillators 1400

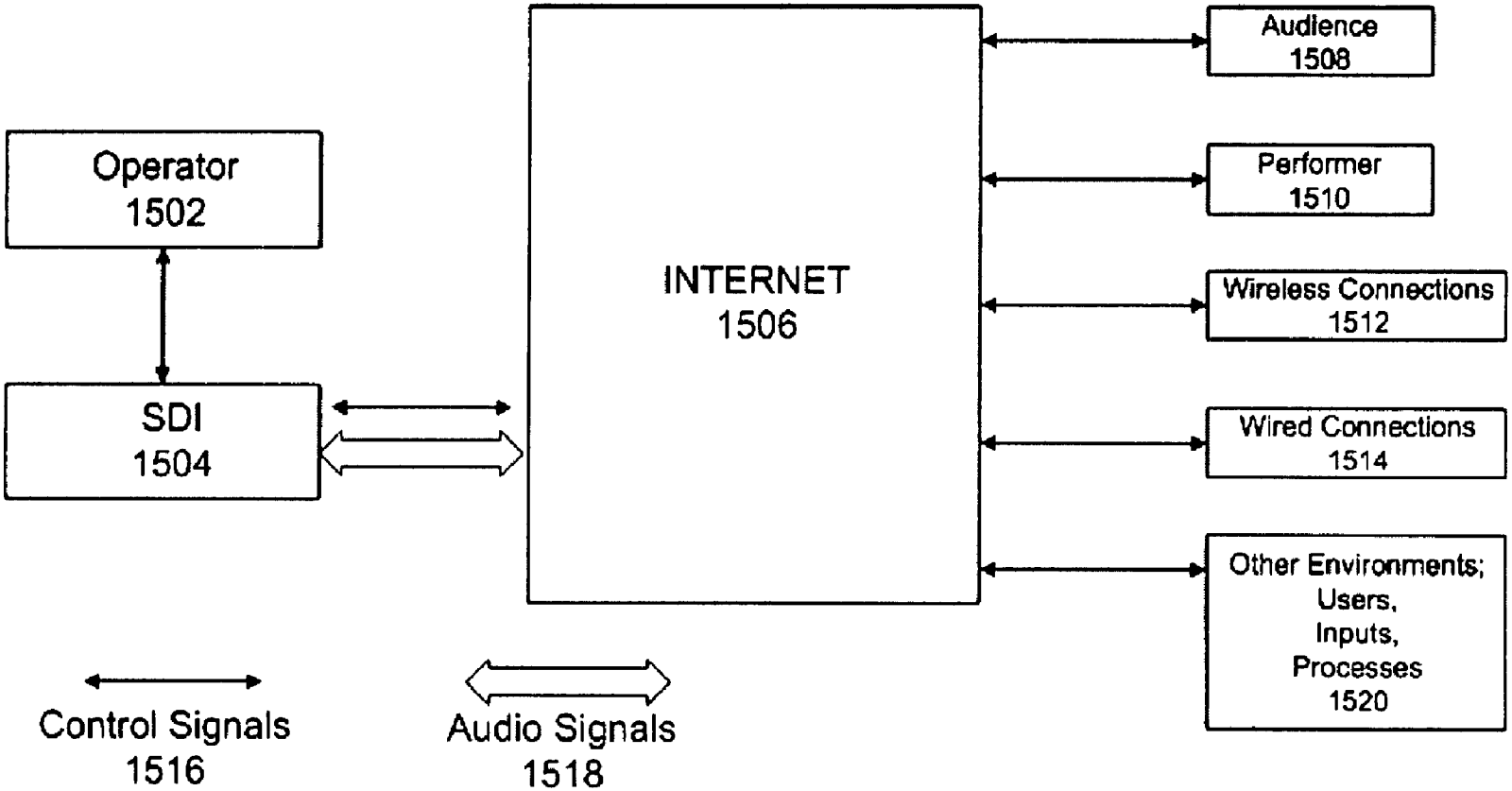
Figure 15. SDI Internet Connections 1500

SOURCE-DEPENDENT ACOUSTIC, MUSICAL AND/OR OTHER INSTRUMENT PROCESSING AND FEEDBACK SYSTEM

CROSS REFERENCE TO RELATED APPLICATION(S)

This application claims priority from U.S. Provisional Patent Application Ser. No. 60/835,875 filed Aug. 7, 2006, and which is incorporated by reference herein.

BACKGROUND OF THE INVENTION

Musical sounds and events are indicative and reflective of human culture's perception, understanding, and production of sound, language, and meaning. Music is generally performed based on human intention by the actions of the body and also the manipulation of musical instruments, and considered a form of artistic expression. Musical instruments have evolved along with technology. Musical compositions, performances, and events may be predetermined to the extent possible by human intention (musical composition) or left to be partially or completely improvised based on human-provided structures (Indian Ragas, Jazz). Other independent sources of musical sound have also long been recognized, either from natural or animal sounds (birds singing, water moving among rocks, wind moving among structures) or environmentally stimulated musical devices produced by human ingenuity (wind chimes, Aeol's harp).

In some forms of music, acoustical and natural laws provide structure (scales, chords) but in other forms of music (mostly electronic) more general acoustic phenomena and structures (atonality, serialized tones and rhythm, noise spectra, and sound events in an environment) may be recognized as musical.

Music is mainly performed by trained artists, but sometimes the "audience" also participates in a musical event (clapping, cheering, singing along, etc.).

Human artistic determination of music (composition, improvisation) is generally accepted, but random generation and machine or computer determination are also used to alter or create musical events.

SUMMARY OF THE INVENTION

The improvement by this invention is to incorporate all of the above resources and means in an instrument that can produce musical sound, spanning the range from complete determination by an artist to expressing natural or environmental sound-determining inputs through a musical structuring device or system to produce musical events, and additionally to make musical events interactive, including participation of an audience.

Additionally, the invention utilizes the above structures and methods to provide musical events responsive to a feedback between instrument/audio input, instrument processing structure, and instrument output to the instrument's input or to an acoustic/audio environment in which the instrument's input is a part. The environment may generate the acoustic/audio input to the SDI.

A source-dependent musical instrument receives and processes an audio input signal and produces an audio output signal dependent on analysis of the input signal, a control parameter specification, internal state of the instrument, signal processing of input signal, generation and signal processing of synthesized signal, controlled feedback of the instrument output to the instrument input, and controlled feedback of output to the environment of the input. The feedback loop can also be separated to feedback within the instrument and also include the acoustic environment into which the instrument's output is radiated.

The input to the instrument may be intentional, as by manipulation by a musician; or indeterminate, as by monitoring an environmental sound source or an arbitrary input signal; or interactive, such as by monitoring a quasi-indeterminate sound source (a crowd or an audience) and providing acoustic feedback from the instrument into the environment of the sound source (dance hall or auditorium).

The control parameters specify:

One or more formats for analysis of aspects of the input signal, audio processing of the audio input signal by delay, reverb, phase, distortion, filtering, or modulation, generation of (synthesized) secondary audio signals based on the analysis of the input signal and the state of the control parameters by an oscillator, or digital or analog methods, audio signal processing of the secondary signal, audio processing of combined signals, feedback combination of the input signal, processed input signal, and processed secondary signal, feedback from the acoustic environment into which the output signal is transmitted, feedback of the combined output signal to the input signal, and feedback of output signal to environment of input signal.

Embodiments of the source-dependent musical instrument may be acoustic (sound focusing space), acoustic-mechanical (wind chime, Aeol's harp), acoustic-electroacoustic (microphone, amplifier, or speaker feedback), acoustic-electronic (analog SDI), acoustic-digital (digital SDI processing); electroacoustic (analog input)-(allsecondary_, electronic-allsecondary, digital-allsecondary).

BRIEF DESCRIPTION OF THE DRAWINGS

FIG. 1: Shows the general concept of an SDI operating within an audio or acoustical environment.

FIG. 2: Shows the functional elements of a generalized SDI.

FIG. 3: Shows a particular version of SDI, emulating a particular embodiment concept of a "sympathetic string" electronic synthesizer/emulator.

FIG. 4: Shows an example implementation of the system of FIG. 3, as a five "voice" sympathetic string emulator.

FIG. 5: Shows a computer/digital SDI system based on FIG. 3.

FIG. 6: Shows a control panel/display screen for computerized SDI.

FIG. 7: Shows internal feedback for one of the control parameters.

FIG. 8: Shows feedback into the environment for one of the control parameters.

FIG. 9: Shows input frequency waveforms for "input tonality."

FIG. 10: Shows gated and amplitude envelope generation provided by the control signals.

FIG. 11: Shows infinite possible outputs from the SDI.

FIG. 12: Shows multiple users setup for SDI communication.

FIG. 13: Shows SDI implementation on an integrated circuit chip.

FIG. 14: Shows input filter and oscillator tuning to simulate a dense string which allows for a large quantity of available tones (1 octave yields 43 tones, etc).

FIG. 15: Shows possible communication by SDI operator through the Internet.

DESCRIPTION OF THE PREFERRED EMBODIMENT(S)

In a computerized version of the SDI, a visual display provides indication of the system control parameters and other indicators of operation and an input device (computer or musical keyboard, mouse, trackball, instrument simulator, other), and that includes a digital encoded input (in real time) and a digital stored file input.

A control panel or alternative control device is provided. Examples include an analog control panel, keyboard, mouse, and a touch screen.

An example embodiment of the SDI is loosely based on the acoustic "sympathetic strings" implemented on musical instruments such as the sitar. For this embodiment:

The input signal, which may be intentional (as guitar played into), indeterminate (microphone input), or interactive (as crowd input/output) feeds into an analysis means (device and/or algorithm); which extracts frequency and loudness information.

The frequencies of an "input tonality" are specified by structures of single frequencies or groups of multiple frequencies.

When the input signal contains frequency components conforming to the specified input tonality, the analysis system outputs control signals according to, for example, the amplitude of each chosen frequency or tonality detected in the source material, or the onset time for a frequency component. For a tonal system the output tonality is related to the input tonality, and for non-tonal systems the output event is related to the input event.

The control signals, for example in a fixed number of channels, provide gating and/or amplitude envelope generation for allowing the synthesized signals from a corresponding number of oscillators or tone-synthesizing channels to be passed through to the output sections of the device.

An input event is the recognition of a frequency, group of frequencies, or other defined audio pattern by an "input filter" which may be a bandpass filter, comb filter, or other single or multiple filters. The configuration of all possible input events through the input filters of an SDI is the input tonality.

The tones of the secondary synthesizers, collectively termed the "output tonality", may be generated at frequencies equal to the frequencies set for the input tonality. However they may also be set to generate tones of different frequencies specified by either a frequency ratio or any other method, (i.e. filtering or delay) or changed in predetermined or partially determined sequence or at random.

Available to the tone generators are settings for the frequency inputs and outputs for the tone generators, by which the user can adjust the sonic character of these tone generators. Also present are controls for attack-decay volume envelope as well as mixer settings for a rectangular, triangular, or sine wave.

Likewise the signal processing of the tones generated by the secondary synthesizers may be specified according to a fixed structure, or be based on analysis of the input signal, or varied in sequence or at random or according to a computational algorithm (VC filter, VCA, FFT, etc.).

An output configuration/tonality is the configuration of all possible output events created by output synthesizers.

The input signal itself may be processed by the signal processing system, either separately from the secondary synthesized signals or mixed with the secondary signals according to fixed parameter, parameters derived from the signal analysis section, etc (i.e. by filtering, compression, distortion, delay, reverberation, etc).

The processed signals may also be fed back to the input stage according to the mentioned methods, and are fed to an output stage (i.e. just attenuated or with additional processes).

A harmony compensating SDI could correct vertical relationships at each moment in a musical event, for a given tuning.

The output signal (the signal produced by the output stage) may be amplified and converted to an acoustical signal. The acoustical or digital output may be directed to an audience (radio, internet, or "live"), to a performer, and/or both according to the methods described.

The instrument may consist of a single audio or acoustical path, or multiple paths (stereo, quad, etc) with channel replication (1 channel, 4, 10, etc.) in the software.

The inputs, processing and outputs of the device may be in a single location or multiple locations connected by available communication channels (wire, wireless, internet, satellite, etc.). The channels may be single or multiple through identical SDI processes, or through different processes for each channel.

Likewise the operations determining the processing parameters may be provided by a single or multiple human operators or automata, connected by available communications channels. A single channel could be one player with a guitar, SDI, or amp-speaker, and multiple channel operation could be a group of players with the audience experiencing the produced musical events over the Internet.

In this way any musical event generated or processed by the SDI may be interactive to any degree specified.

Any of the events, signals or control parameters may be recorded using any available recording medium and technology, and any recording may be used in further signal generation and processing. The recorded material may be played back later as a musical performance, or may be used as part of material for a new or ongoing musical event.

Instead of, or in addition to analyzing the input signal according to a "tonality" or frequency series, alternative input "event" specifications may be utilized. For example, the analysis system may be specified to recognize symbols, spoken or sung words (speech recognition), or other sound sequences that are better specified by noise spectra (drums, cymbals, etc).

Likewise the secondary signal generators may generate "events" such as words, noise spectra, etc (i.e. each oscillator could be a speech synthesizer).

Secondary signal generators may also be extended to include non-audio signals or events, such as visual signals, mechanical motions, and other that can be produced by activation by electronic or digital signals such as lights, vibrations, or theatrical effects.

Input sources may also be encoded to include non-audio signals or events, transduced by appropriate transducers and analyzed by input event "filters" to generate secondary output events.

Input signals can be extended to include optical signals, electromechanical signals, temperature, pressure, humidity; in general any event or stimulus that can be converted into electronic or digital signals by a transducer. This is important for tuning the input signal to the output signal, or vice versa.

The input signals can be created intentionally by one or more users, or by environmental sources, by pre-determined programs, or combinations of these, such as instrument players, or outside traffic, etc. This could include, for example, hummingbird songs translated down from ultrasonic frequencies and used for SDI manipulation.

The analysis system parameters can be intentionally manipulated by one or more users, or by environmental sources, by predetermined programs, or combinations of these to create, for example, a multi-player instrument/event (like a game).

The same applies to the signal synthesis or event generators, and the same applies to the control of signal processing and feedback systems.

The SDI could also be made into an inexpensive, integrated circuit chip for toys (finding the music in sounds) or possibly other musical applications.

A possible use of the SDI includes feedback to and from, for example, a club environment. In this case the audience provides audio input and the operator of the instrument can "play" the SDI to correspond interactively to reactions from the audience.

Another use might be to input environmental sounds in a residence near a highway, and output sounds that create a more harmonious acoustical environment when mixed with the incoming sounds.

In summary, the operation of both the input and the control of the instrument may vary in a range including determinate, intentional, improvised, and randomly determined.

Using internet and other long-distance communication systems, the inputs, controls and outputs may be distributed at single and/or multiple locations reasonably simultaneously. Thus, large-scale musical and/or artistic events may be performed and attended by arbitrarily large and diversely located group(s) of participants, or the "audience."

The following appended material describes other specific embodiments, details of implementation, uses and additional inventive features. All inventive features specified are believed to be enabled by currently available technology accessible to those skilled in the related fields of practice.

Although various embodiments and alternatives have been described in detail for purposes of illustration, various further modifications may be made without departing from the scope and spirit of the invention. Accordingly, no limitation on the invention is intended by way of the foregoing description and drawings, except as set forth in the claims to be appended to the non-provisional version of this disclosure.

FIGURES

FIG. 1: 100—Shows the general concept of an SDI 110 operating within an audio or acoustical environment 102. The SDI operation is determined by inputs to a controller 104. Audio signals from the environment 102 are input to the SDI 110 either directly or optionally through an input transducer 112. The signal output from the SDI is transmitted back into the environment 102.

FIG. 2: 200—Shows the functional elements of a generalized SDI 102. The environment 202 provides signal sources called primary sources 204 either directly or through one or more transducers (not labeled). The audio inputs 206 from the primary sources 205 are then fed to the diagnosing element 210 and the signal processing elements 216. The diagnosing elements are also called analysis elements interchangeably. The output 211 of the analysis elements is connected to Function Generators 212, and also to secondary signal generators 214. The outputs 213 of the function generators 212, the secondary signal generators 214 and also optionally the audio inputs 209 are fed into the signal processing elements 216. The signal processing output 217 may be sent through a feedback element 218 back into the audio inputs 206 via signal lines 219. Optionally in addition the feedback signals may be sent to the environment 202 via separate signal connections 221, and 225. The outputs of the signal processor 216 are sent 217 to amplifiers and output transducers 220 for conversion into acoustic signals 221. These acoustic signals reach the ears 222 of the listener 228. The listener may also be the operator 230 of the control system 208. The control system may be operated by the operator, on internal settings or programmed control by a computer or other programming device. The SDI output from 220 may also be sent out by internet 226 or by radio 232 into the environment, as well as by any other interface for the transmitting signals into the environment 202. The paths of all control signals are denoted by dashed lines 240. The audio signals are denoted by parallel lines 250. Other non-audio signals are denoted by lines 260. The signal and control lines 240, 250, and 260 may be electronic analog or digital signal lines, or also wireless signal lines, or optical signal lines. All components of the system may be mechanical, electronic, analog, digital, optical, or wireless in their operation and connection.

FIG. 3: 300—Shows a particular version of SDI, emulating the general concept of a "sympathetic string" electronic synthesizer/emulator. The emulation of a sympathetic string can be modeled with varying degrees of complexity. This is a very simple model for the purpose of basic illustration. The input 302 (after transduction into electronic or digital format) is fed to a narrow band bandpass filter 304. The filter's center frequency is tuned to a particular frequency of reference. If the input signal contains a frequency component corresponding to the filter's resonant frequency, the filter output 305 may trigger, for example, an exponential envelope generator well known in the art.

The envelope generator 308 outputs a control signal 309 (analog, digital, etc as appropriate to the embodiment) to the control input 311 of a voltage controlled (or digitally controlled, etc) attenuator or amplifier 310. An oscillator 310 (which may be analog, digital, algorithm, etc), having a frequency determined by a control input 3112, generates an audio frequency, which may optionally be the same frequency as the center frequency of the narrow band filter 304. The oscillator output 3113 is coupled to the audio signal input 3111 of the voltage controlled attenuator. The resulting output 314 of the voltage controlled attenuator is an independently generated signal having a frequency corresponding to the input "center" frequency, and having its own envelope characteristics. When an input having the same frequency component is detected, the corresponding output signal is generated. Multiple channels of this system are contemplated, as well as alternative emulation models. Control systems are denoted by 320, 322, and 324.

FIG. 4: 400—FIG. 4, based on the model of FIG. 3, shows a detailed expansion to (for example) a five channel model. The input signal 402 represents the audio or acoustic input and any processing input stage 404. The audio signal is sent via 405 to all filter inputs. The bank of filters 408 has five filters, each having a center frequency and voltage input specified. Each filter output 409 is sent to a corresponding envelope generator 410, with parameters such as attack time Tc (response time to reach an initial rising level) and decay time Td corresponding to response time to a falling level.

The envelope generator outputs are fed to the control inputs of voltage (for example) controlled amplifiers 412. Each VCA is fed by the audio signal output of a corresponding oscillator 418 having at least an oscillation frequency determined for each oscillator. The VCA audio signal outputs are summed by the output stage 416 and transduced into an output signal Vo (a voltage, digital sequence, etc) and out to the environment. The control elements 406 provide for setting all the control parameters by a user interface (not shown) which may consist of analog or digital input control devices (knob, button, touch screen, digital input, MIDI input, etc).

FIG. 5: 500—The SDI may be partially or completely implemented using a digital computer 500 and associated input, output, display, and control devices. In this illustration the input 502 is an audio input of one or more channels through one or more input transducers. The computer processes 506 emulate or provide all the processing functions regarding the audio signal. The controls 508 (computer, keyboard, mouse, musical keyboard, touch screen, trackball, etc) are analogous to any analog controls that might otherwise be used, and in addition can interface with analog controls such as switches, potentiometers, etc. The display (LCD, CRT, etc) provides a visual indication of settings, processes, audio signals, and other operating information to the operator or user 520. The output 510 may be one or more audio or other signals, either as acoustic output, electronic, digital, internet, or wireless. The output is sent to the performer, operator, audience, recording media, etc.

FIG. 6: 600—An example control panel and display screen 600 depicts a simple computerized realization of a "sympathetic string" SDI model.

Icons and displays on the panel can be manipulated by computer keyboard, musical instrument (MIDI interface), keyboard, mouse, touch screen, etc. Icon 602 controls the amplitude of an input audio signal. Icon 604 displays an activity level for each of 8 channels. Icon 608 provides a reference tuning signal for the user/operator, which can be pre-set numerically or by pitch analysis of an audio input signal. Icon 610 allows for the selection of MIDI inputs and output interface for the SDI. Icon 612 allows control of the computer sound card settings. Icon set 613 provides control and display of the gate threshold level, and envelope attack and decay time controls set by the operator. Icon 614 allows for setting of wave-symmetry of triangle and pulse waveforms for the oscillator for all channels. Icon 615 provides mixing the output levels of sine, triangle, and pulse waveforms of the oscillators to the output path.

Element 616 is an input/output frequency scaler, to allow a pre-computed frequency offset or ratio between input frequencies detected and output frequencies synthesized.

Element 618 is a harmonic series generator to enable the preset of input filters and/or output oscillators according to an integer harmonic series for each input frequency chosen.

Element 619 is a device for the setting, saving, and recall of "preset" settings for SDI parameters such as input/output tonalities, etc. In addition to creating the presets, the user can choose to automatically step between sequences of presets, creating the equivalent of "chord progressions" of preset input/output tonalities and other parameters.

Element 620 is an icon for the recall and sequencing functions.

Element 622 is a device for the detection of a "pitch" in the input audio signal, and the insertion of the detected pitch as an input and/or output tonality for each of the channels, or "voices."

Element 628 is an extended musical staff for the insertion and visualization of the cumulative input and output tonalities.

Element 626 is a device for providing a numerical input of the frequencies for all voices of the input and output tonalities.

Display 624 displays a waveform 630, which indicates the FFT of the input waveform, and is denoted as input spectrum.

Display 632 displays the output spectrum.

Display 605 displays the input tonality of each channel, alongside the spectrum display. Each line indicates the frequency of the input for the corresponding voice. In addition, a display line will also appear whenever an input is detected corresponding to the frequency of any voice channel.

Numerous other features of the embodiment shown will be available in the user manual for the associated device release.

This embodiment was created and runs on a personal computer with either WINDOWS or MAC operating systems, and/or audio input/output card.

The software realization was created in a language "MAX/MSP", but could equally well be created using other programming languages, tools, operating systems, or computers.

FIG. 7: 700—The output 710 of one or more sections of the SDI 706 may be fed back in some form through a feedback controller 708, to the electronic or digital input 704 and thus be combined with the input signal 701 from the environment 702. Note that the feedback controller 708 may simply be a variable attenuator of the output signal 710, or a more complex processor such as a frequency-selection equalizer or even as complex a process as a separate SDI 706.

FIG. 8: 800—The feedback of the SDI may also be sent to the environment 702, from which is derived the input signal 701. In this embodiment the total audio/acoustic environment 802 may consist of a three-dimensional acoustic environment 802 with multiple audio sources and sampling points for input signals 803. The environment may be more complex, consisting of (for example) multiple locations served by internet, radio, or wireless transducers. The environment may include multiple audiences, performers, locations, input-output transducers, channels, and local sources of audio signal processing. Feedback processor 806 may vary between each environment. In this manner, very complex interactions between performers, audience, ambient sounds, automated processes, random processes, time delays, etc may take place in the realization of the sound and musical events.

FIG. 9: 900—In an input filter within the SDI, a multiple frequency response may be used. A single frequency 902 may represent the "fundamental" frequency of a musical tone. Multiple frequencies 904, for example with harmonic integer multiples of the fundamental frequency 902 may increase the selectivity of the SDI to extract a particular overtone series corresponding to a musical tone much more accurately than a single frequency which might be based on spectral content of any number of fundamental tones.

Also, the SDI filter may select non-harmonic combinations of frequencies to further specify particular musical events such as multiple tones, etc. Example: overtone series of F1 frequency=F1, 2F1, 3F1 . . . and also overtone series of f2 frequency=f2, 2f2, 3f2, 4f2, . . . .

FIG. 10: 1000—The input filters may feed into an envelope control circuit which consists of a gate signal, which may be "OFF" 1002 when insufficient signal is detected by any filter, and "ON" 1003 when a sufficient signal has been detected. The input signal may then trigger or control a secondary envelope signal generator 1004 that creates a pattern or patterns of time-varying amplitude or other control for the secondary synthesized signal. Envelope generators, followers, gates, etc are well known in the art.

FIG. 11: 1100—The SDI 1106 may operate on multiple audio inputs (1102, 1103, and 1104) such as stereo, quad, etc, and provide multiple audio outputs (1108, 1110, and 1112) corresponding to each of these inputs. Any SDI architecture described here can be implemented in multi-channel realizations.

FIG. 12: 1200—Multiple users (operators, performers) can control the SDI by either the control settings, sound inputs, or both. User 1 1202, and User 2 1202 may operate on the control inputs. User 3 1206 may provide audio inputs. The SDI 1208 processes these into the environment 1210.

FIG. 13: 1300—Due to advancements in electronic fabrication, an SDI may be actively constructed on a chip at low cost. This enables various uses in toys, greeting cards, and inexpensive systems. Also, the enablement of very complex SDI systems with many chips is possible.

FIG. 14: 1400—By implementing very closely spaced input filters in an SDI, a dramatically different and acoustically nearly impossible effect may be obtained. For example, the input may be a harpsichord tuned in equal-tempered temperament. The input filters of the SDI can analyze the acoustic signal to determine the notes played at any time interval. The output oscillators may be tuned variably, or multiple output oscillators per input filter may be selected so that any vertical (chord) structure can be manifested in "just" tuning and thereby eliminate dissonances imposed by the equal temperament as the instrument plays in various harmonic transitions, keys, or chord progressions.

FIG. 15: 1500—The connection of an SDI to the internet 1506 may enable the use of various different sound environments 1520, performers 1510, users 1520, and operators 1502. The connection of all these may facilitate interactive and quasi-simultaneous musical events on a different scale than presently understood in the composition, performance, and appreciation of musical art.

All inventive features specified are believed to be enabled by currently available technology accessible to those skilled in the related fields of practice. Although various embodiments and alternatives have been described in detail for purposes of illustration, various further modifications may be made without departing from the scope and spirit of the invention. Accordingly, no limitation on the invention is intended by way of the foregoing description and drawings, except as set forth in the claims appended to this disclosure.

What is claimed is:

1. A source dependent instrument signal processing and signal generation system for a source dependent instrument which produces musical sounds, comprising:

an input interface for generating an input signal in response to and representative of an input event including an audible input event occurring in an environment external to the source dependent instrument signal processing and signal generation system and instrument and having input signal parameters, the audible input event comprising a quasi-indeterminate sound generated by at least one of (i) another sound source other than sound outputted by the source dependent instrument signal processing and signal generation system, and (ii) a plurality of people, and the input signal parameters including an audio parameter of the plurality of people;

analysis elements for receiving and analyzing the input signal to determine parameters thereof;

at least one function generator and at least one secondary audio signal generator for receiving the input signal from the analysis elements and the function generators outputting a control function signal based on and in response to the input signal and the secondary audio signal generators outputting a secondary audio signal based on and in response to the input signal;

an audio signal processer receiving the input signal and at least one of the control function signal and the secondary audio signal and responsive thereto for at least one of re-synthesizing the input signal and shifting parameters of the input signal to provide a first output signal having output parameters shifted in relation to and based on and responsive to the input signal parameters;

an output stage responsive to the first output signal from the processer for generating a second output signal responsive to the first output signal; and a controller for adjusting at least one of the re-synthesizing and parameter shifting performed by the processor, further comprising a feedback loop for receiving the second output signal and feeding the first output signal back to the environment, and wherein the controller controls the feedback, wherein the environment is external to the source dependent instrument and the source dependant signal processing and signal generation system.

2. The source dependent instrument signal processing and signal generation system of claim 1, wherein the second output signal comprises musical sounds.

3. The source dependent instrument signal processing and signal generation system of claim 1, wherein the feedback loop is a first feedback loop and there is an additional feedback loop which feeds the first output signal back to the input interface through feedback signal lines that are coupled to the input interface.

4. The source dependent instrument signal processing and signal generation system of claim 1, wherein the analysis elements determine an input tonality of the input signal using FFT analysis, and wherein the first output signal includes a first output signal component based on the input tonality and the output signal includes a signal component based on the input tonality.

5. The source dependent instrument signal processing and signal generation system of claim 1, wherein the audible input event is further comprised of a specific predetermined sound, and the input signal parameters include the specific predetermined sound.

6. The source dependent instrument signal processing and signal generation system of claim 5, wherein a non-verbal sound is generated by a person operating a musical instrument located in the environment.

7. The source dependent instrument signal processing and signal generation system of claim 1, further comprising an additional input transducer for generating an additional input signal in response to and representative of a non-auditory event occurring in the environment external to the system and instrument and having additional input signal parameters.

8. The source dependent instrument signal processing and signal generation system of claim 7, wherein the processor comprises:

a bank of filters, each filter of the bank of filters being configured to receive the input signal and each having a corresponding center frequency and a corresponding signal input;

a set of envelope generators coupled to the bank of filters, each envelope generator being configured to receive an output of a corresponding filter of the bank of filters, and each envelope generator being configured to operate in accordance with at least an attack time Tc parameter and a decay time Td parameter;

a set of oscillators for generating audio signals;

a set of signal controlled amplifiers coupled to the set of envelope generators and the set of oscillators, each signal controlled amplifier being configured to receive the output of a corresponding envelope generator and a corresponding oscillator; and an output stage coupled to the set of signal controlled amplifiers for summing the output of each voltage controlled amplifier to generate the first output signal.

9. The source dependent instrument signal processing and signal generation system of claim 8, wherein there is a control interface for operating the system, and wherein the controller is coupled to each of the bank of filters, the set of envelope generators, the set of oscillators, the set of signal controlled amplifiers, and the control interface.

10. The source dependent instrument signal processing and signal generation system of claim 7, wherein the non-auditory event is comprised of at least one of (i) a temperature change in the environment, and the additional input signal parameters include a temperature change parameter, (ii) a humidity change in the environment, and the additional input signal parameters include a humidity change parameter, and (iii) a light change in the environment, and the additional input signal parameters include a light change parameter.

11. The source dependent instrument signal processing and signal generation system of claim 1, wherein the quasi-indeterminate sound is generated by a plurality of people.

12. The source dependent instrument signal processing and signal generation system of claim 1, wherein the first output signal is one of an analog and a digital signal, and the system further comprises means for feeding back the first output signal to at least one of the processor and an output stage.

13. A method of source dependent instrument signal processing and signal generation for a source dependent instrument which produces musical sounds, the method comprising the steps of:

generating an input signal in response to and representative of an audible input event occurring in an environment external to the source dependent instrument and having input signal parameters, the audible input event comprising a quasi-indeterminate sound generated by at least one of (i) another sound source other than sound outputted by the source dependent instrument, and (ii) a plurality of people, and the input signal parameters including an audio parameter of the plurality of people;

at least one of re-synthesizing the input signal and shifting parameters of the input signal and providing a first output signal having output parameters shifted in relation to and based on and responsive to the input signal parameters;

generating a second output signal responsive to the first output signal;

controlling at least one of the re-synthesizing and parameter shifting of the processor using a controller further comprising a step of feeding the second output signal back to the environment, wherein the environment is external to the source dependent instrument and a source dependant signal processing and signal generation system; and feeding the first output signal back to an input transducer through at least one feedback signal line.

14. The method of claim 13, wherein in the step of at least one of re-synthesizing and providing, the second output signal comprises musical sounds.

15. The method of claim 13, wherein in the step of at least one of re-synthesizing and shifting, the input signal is re-synthesized and the parameters are shifted.

16. The method of claim 15, wherein in the step of at least one of re-synthesizing and shifting, the input signal is input from an audio interface to analysis elements as an audio signal and then output to function generators and signal generators, and the function generators output a signal to signal processing elements, and there is also a step of the signal generators providing an audio output signal to the signal processing elements, and a step of feeding the input signal from the audio interface to the signal processing elements, and a step of the signal processing elements outputting a signal processed audio signal as an initial output for the step of feeding the first output signal back to the environment, and as the initial output for a step of feeding the first output signal to the audio interface, and there is a step of amplifying and transducing the signal processed audio signal and outputting acoustic sounds to the environment.

17. The method of claim 13, wherein in the step of generating an input signal, the quasi-indeterminate sound is generated by a plurality of people.

18. A source dependent instrument signal processing and signal generation system for a source dependent instrument which produces musical sounds, comprising:

an input transducer for generating an input signal in response to and representative of an input event including an audible input event occurring in an environment external to the source dependent instrument signal processing and signal generation system;

an environment for providing an audible input event from which to generate audible input signals to an audio input interface, the audible input event comprising a quasi-indeterminate sound generated by at least one of (i) another sound source other than sound outputted by the source dependent instrument signal processing and signal generation system, and (ii) a plurality of people, and input signal parameters including an audio parameter of the plurality of people;

analysis elements for analyzing the input signals received from the audio input interface and outputting responsive signals to function generators and signal generators, wherein the signal generators generate audio signals;

signal processing elements receiving the output of the function generators and the audio signals output from the signal generators for producing signal processed audio output signals;

an initial feedback loop for feeding back the signal processed audio output signals to the audio input interface through feedback signal lines that are coupled to the audio input interface;

an additional feedback loop for feeding back output of the initial feedback loop to the environment; and amplifying and output transducers receiving the signal processed audio output of the signal processors for amplifying the signal processed output and producing acoustic signals to the environment and to a controller connected to the audio input interface, the analysis elements, the function generators, the signal generators, the initial feedback loop, and the amplifying and output transducers.

19. The source dependent instrument signal processing and signal generation system of claim 18, wherein the source dependent instrument signal processing and signal generation system receives input signals via the internet.

* * * * *